US008422932B2

(12) United States Patent
Steven

(10) Patent No.: US 8,422,932 B2
(45) Date of Patent: Apr. 16, 2013

(54) ACTIVE SHEET STRIPPING FROM BELT VIA SMALL RADIUS FEATURE

(75) Inventor: Moore R Steven, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 518 days.

(21) Appl. No.: 12/713,738

(22) Filed: Feb. 26, 2010

(65) Prior Publication Data

US 2011/0211886 A1 Sep. 1, 2011

(51) Int. Cl.
*G03G 15/00* (2006.01)
*G03G 21/00* (2006.01)

(52) U.S. Cl.
USPC ..... 399/398; 399/22

(58) Field of Classification Search ..... 399/22, 399/398
See application file for complete search history.

(56) References Cited

U.S. PATENT DOCUMENTS

| | | | | |
|---|---|---|---|---|
| 4,062,631 | A * | 12/1977 | Ichikawa et al. | 399/164 |
| 5,239,351 | A * | 8/1993 | Mahoney | 399/164 |
| 2011/0064438 | A1 * | 3/2011 | Fukuda et al. | 399/68 |

FOREIGN PATENT DOCUMENTS

| | | | | |
|---|---|---|---|---|
| JP | 09185268 | A | * | 7/1997 |
| JP | 11059962 | A | * | 3/1999 |
| JP | 2002031927 | A | * | 1/2002 |
| JP | 2003302858 | A | * | 10/2003 |
| JP | 2010139603 | A | * | 6/2010 |

* cited by examiner

*Primary Examiner* — Matthew G Marini
*Assistant Examiner* — Nguyen Q Ha
(74) *Attorney, Agent, or Firm* — Ronald E. Prass, Jr.; Prass LLP

(57) ABSTRACT

This invention provides a method to strip a media sheet that is adhered to an image carrying belt surface so that the sheet can follow the subsequent intended path through a marking system. The belt can be a photoconductor belt or an intermediate transfer belt.

The stripping feature of this invention is located movably adjacent to a back-up roll in a transfer station of the marking system. The stripping feature has a radiused belt contact portion. After the sheet has an image transferred thereon from the belt, sometimes the sheet adheres to the belt, which can be disruptive to the system. This invention provides that the stripping feature can be selectively deployed so that its radiused belt contact portion presses against the inside of the image carrying belt, thus temporarily deforming the belt and thereby causing the sheet to release therefrom.

16 Claims, 7 Drawing Sheets

ACTIVE SHEET STRIPPING FROM BELT VIA SMALL RADIUS FEATURE

This invention relates generally to a printing system, and more specifically, concerns a structure for transferring a material image from an image carrying belt surface to a media sheet.

BACKGROUND

In a typical electrophotographic printing process, a photoconductive member is charged to a substantially uniform potential so as to sensitize the surface thereof. The charged portion of the photoconductive member is exposed to a light image of an original document being produced. Exposure of the charged photoconductive member selectively dissipates the charge thereon in the irradiated areas. This records an electrostatic latent image on the photoconductive member corresponding to the informational areas contained within the original document. After the electrostatic latent image is recorded on the photoconductive member the latent image is developed by bringing a developer material into contact therewith. Generally, the developer material is made from toner particles adhering triboelectrically to carrier granules. The toner particles are attracted from the carrier granules to the latent image forming a toner powder image on the photoconductive member. The toner powder image is then transferred from the photoconductive member to an intermediate belt or directly to a media sheet. Since the photoconductive member can be a belt, it is common that the media sheet is in contact with a belt. After the media sheet has been separated from the belt, heat and pressure are applied to the toner particles to permanently affix the powder image to the media sheet.

High speed commercial printing machines of the foregoing type handle a wide range of differing thickness media sheets. The bending stiffness of the media sheet is generally a function of the thickness of the sheet. Thus thicker media sheets have greater bending stiffness than thinner media sheets. It is not unusual for the leading edge of a thin media sheet to adhere to the image carrying belt instead of being directed toward the fusing station. This may occur due to the electrostatic attractive force that develops between the media sheet and the image carrying belt at the transfer station, especially for thin flexible sheets or sheets having leading edges that are curled to conform to the belt. This is undesirable since this unwanted adherence can cause a media sheet to be conveyed along an unintended path which may lead to damage of a downstream xerographic system. It is thus known practice to cause the printer to perform an immediate shutdown if it is detected that a media sheet has not properly detached from the image carrying belt.

SUMMARY OF THE INVENTION

While the present invention will be described herein primarily referring to a color xerographic system and use of an intermediate belt, it is understood that this invention can be used in any xerographic process, for example the embodiment of FIG. 1A and not limited only to color systems. The image carrying belt used with the present system can be a photoconductive belt or intermediate belt or any other belt used in a marking system in which the media sheet is separated from the belt for transport to a downstream processing station.

In all xerographic systems, especially high speed color systems, exact and timely stripping of the media sheet from the image carrying belt is essential to proper system timing and print quality. It would be desirable to have available on demand a structure that would assure that the sheet will be detached from the belt when necessary. There are situations where conditions are apt to cause unwanted adherence of the sheet to the belt; these situations are generally predictable, for example, when unusual atmospheric conditions exist, high RH, thin media sheets, etc. Under such stress conditions, a "mis-strip" event may occur wherein the media sheet leading edge fails to detach from the image carrying belt successive to the transfer station. The present invention provides an on-demand procedure to use a deployable structure to eliminate or greatly reduce these mis-strips. The deployable structure consists of a radiused feature that can be brought into contact with the non-image carrying side of the belt. The radius of the feature is intentionally small relative to the radius of the belt guiding rollers. Specifically, the radius of the deployable feature is no more than 25% of the radius of any belt guiding roller. The radiused feature is heretofore designated as the "small radius feature".

This invention provides that a unit designated as the small radius feature is added to the inside of the image carrying belt downstream of the transfer station. This feature is normally retracted away from the belt span. When a media and/or environmental condition are being run that is known to induce mis-strips, the small radius feature is deployed so that it pushes against the inside of the belt and deflects the span downstream of the transfer station. The combination of a small wrap angle and a small radius causes any sheet lead edge that attempts to adhere to the belt to be stripped, since the sheet lead edge cannot follow this curvature. Once the lead edge is separated, it will tend to travel at a tangent to the small radius until it can be guided by a transport or downstream guide or stripper feature that is gapped to the belt. Since the feature is only actuated when stress conditions, for example, (thin media, high RH) are detected, its duty cycle is low and accelerated belt fatigue is minimized. Also, the feature or unit can be preferably actuated prior to belt module cycle-up in order to avoid transient belt loads that would result in color misregistration or banding defects.

As noted above, this invention provides that a small radius feature is added to the inside of an Intermediate Transfer Belt (ITB) downstream of the Back Up Roll (BUR) used in tandem color printers. The radius of the feature is no more than 25% of the radius of any of the guiding rollers for the ITB to ensure that a leading edge of a sheet adhered to the belt cannot conform to the belt over the arc length of contact. The small radius feature including the belt contacting end is preferably made of a rigid material such as metal or plastic.

DETAILED DISCUSSION OF DRAWINGS AND PREFERRED EMBODIMENTS

Figure 1A:
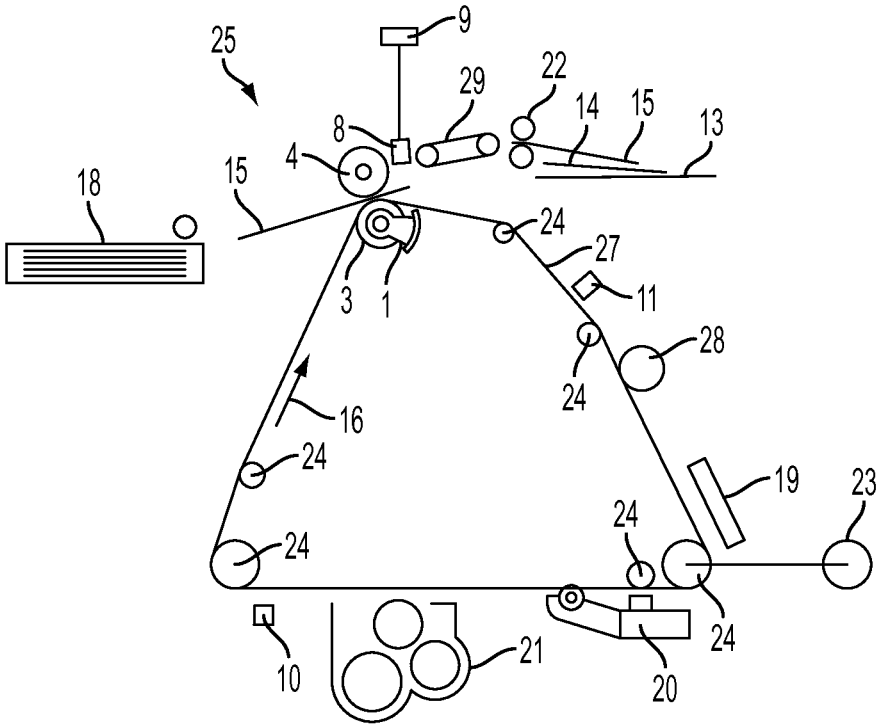
FIG. 1A is a schematic of an embodiment of a typical monochromatic xerographic system where the small radius feature of this invention is used.
Figure 1B:
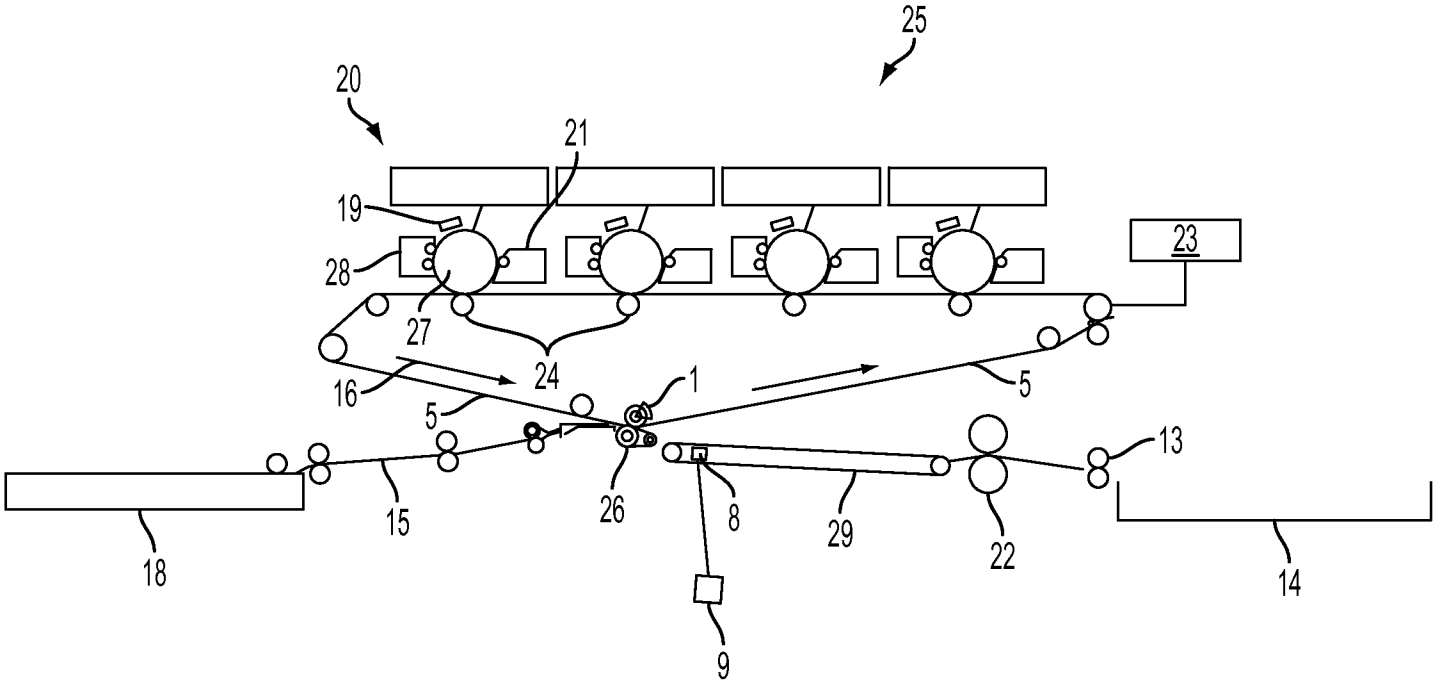
FIG. 1B is a schematic of an embodiment of a color xerographic system where the unit or small radius feature of this invention is used.

In FIGS. 1A and 1B xerographic marking systems 25 are illustrated in a monochromatic and color apparatus respectively; these are shown as simple color and monochrome systems for invention clarity. This type of color system is shown in FIG. 1B and disclosed in co-pending U.S. application Ser. No. 12/115,032, the disclosure of Ser. No. 12/115,032 is incorporated by reference into the present disclosure. The small radius feature 1 of this invention is shown in FIGS. 1A and 1B located coaxially to back up roll (BUR) 3 of transfer station 26 before the paper 15 is transported to fusing station 22. The small radius feature 1 is deployed into a contact position by an actuator (not shown) such as a stepper motor or solenoid. The actuator is connected to a controller 9 with appropriate software which deploys the small radius feature 1 into its operating position in contact with belt 5 (FIG. 1 B) or belt 27 (FIG. 1A) or retracts small radius feature 1 away from the belt. Controller 9 may utilize signal input from sensor 8 as well as other sensors (not shown) within the printer system. The "conventional" components and stations in FIGS. 1A and 1B are: 10. sensor to determine toner density before transfer, 11. sensor to determine toner density after transfer, 13. stacking assembly, 14. collection station, 15. paper, 16. arrows of belt movement, 18. paper feed, 19. charging station, 20. exposure station, 21. developer station, 22. fusing station, 23. motor, 24. rollers, 25. xerographic system, 26. transfer station, 27. photoconductor belt, 28. cleaning station, and 29. transport to fuser.

Figure 2:
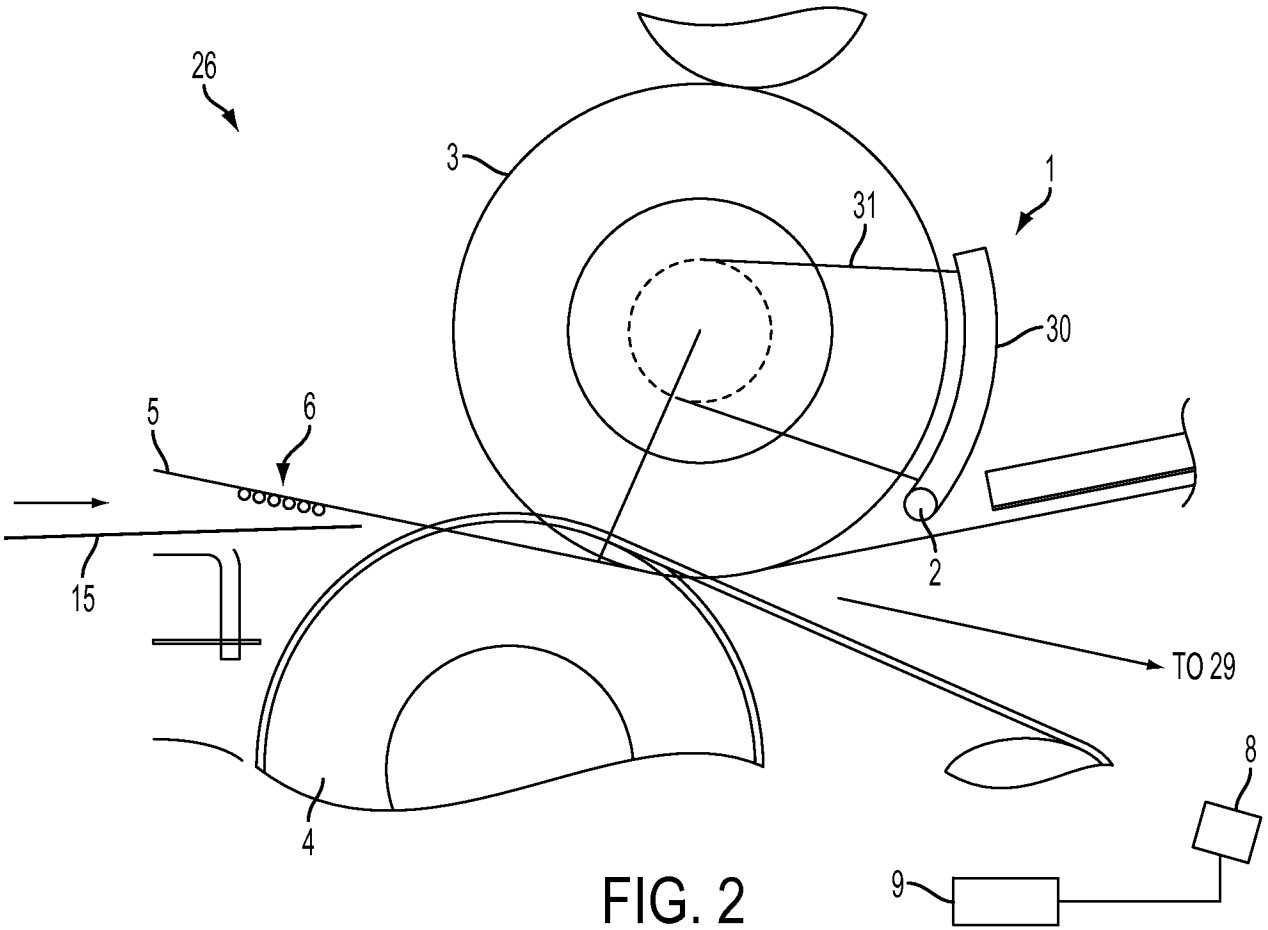
FIG. 2 is a view of some components of a xerographic transfer station where the small radius feature is coaxially mounted with the BUR and the small radius feature is in an inactive position.

FIG. 2 shows a close-up view of the transfer station 26. Stripping feature 1 is located coaxially with the Back Up Roll (BUR) 3. The stripping feature 1 consists of a wedge section that extends the full width of the intermediate transfer belt 5 parallel with the BUR axis. The bottom edge of this stripping feature has a small radius. Each end of the wedge contains an arm 31 rotatably supported so that the stripping feature can rotate about the BUR axis. Stripping feature 1 can be rotated about the BUR axis via an actuator (not shown).The actuator can be a motor or solenoid and spring that acts through a linkage or gear mesh to rotate the stripping feature. The controller 9 can contain any suitable software to control the activation, movement and positioning of unit or feature 1.

In FIG. 2 the BUR 3 and the Bias Transfer Roll (BTR) 4 of the transfer station 26 are shown where the movable small radius feature 1 is in the inactive position not in contact with the intermediate transfer belt (ITB) 5. The toned image 6 was previously deposited on the lower face of the ITB 5 and is transferred to the media sheet 15 where the media sheet 15 and image 6 pass between the Back up roll 3 and bias transfer roll 4. Under normal operating conditions, the leading edge of sheet 15 will emerge from the nip formed by rollers 3 and 4 and separate from belt 5. Sensor 8 is located to sense that the leading edge has stripped from belt 5. After separating from belt 5, the sheet leading edge is guided onto pre fuser transport 29. Under certain stress conditions, sometimes the leading edge of imaged paper 15 may emerge from the transfer nip adhered to the bottom of the intermediate transfer belt 5. When the sensor 8 senses this, it must declare a mis-strip fault. In response, the ITB 5 must be stopped to prevent sheet 15 from interfering with xerographic components located along the ITB downstream from the transfer station.

Figure 3:
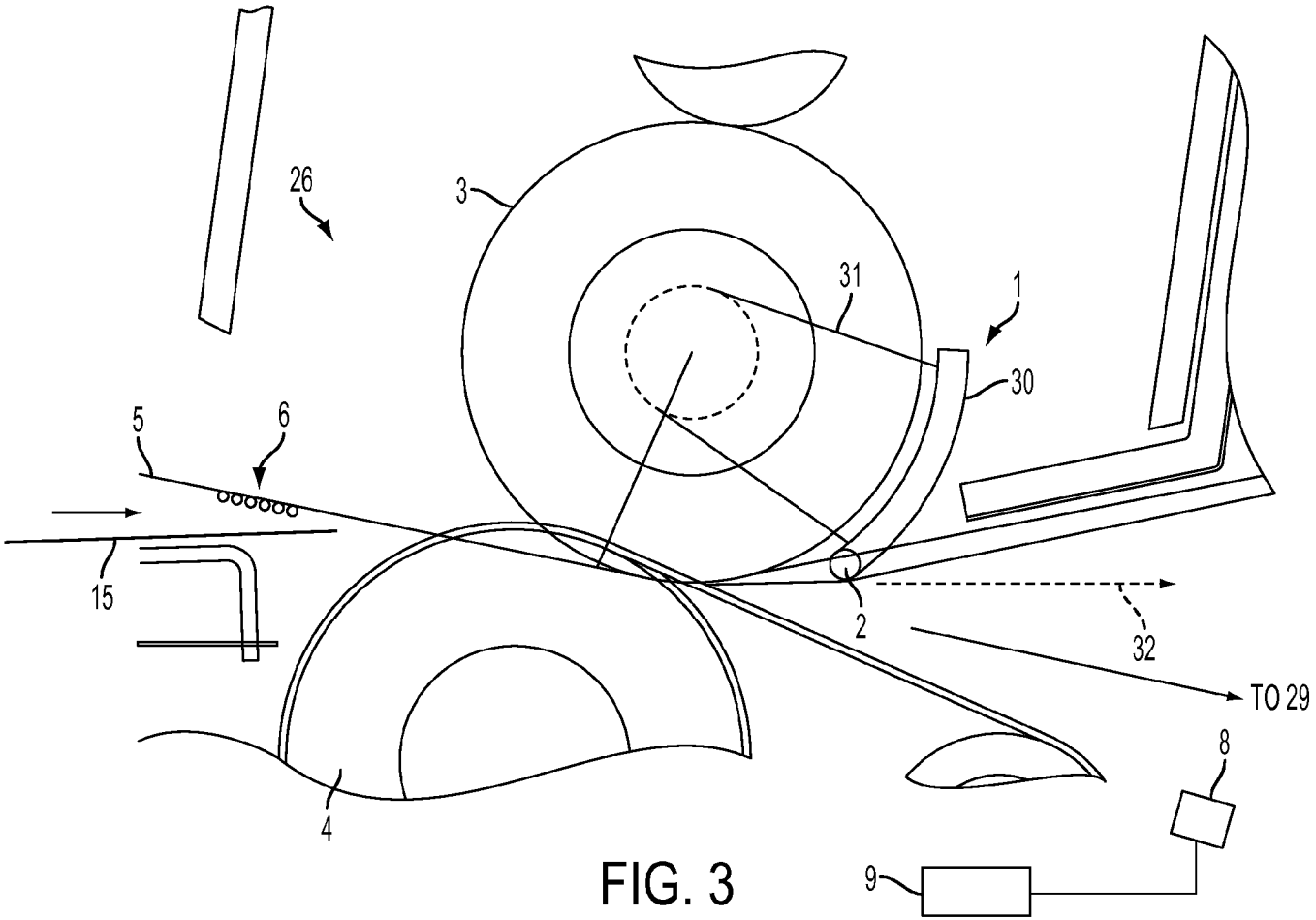
FIG. 3 is a view of the transfer station shown in FIG. 2 with the small radius feature in an active position contacting the intermediate belt.

FIG. 3 shows the stripping feature 1 rotated to its active position. The small radius feature 2 deflects the belt span downstream of the BUR 3. The mis-stripping sheet cannot follow the belt curvature and will self-strip and proceed in a straight line as shown by dotted line 32 and thence onto fuser transport 29.

Since the belt is forced around a small radius, its internal bending stress is much higher than when the belt passes around other rollers in the belt module having substantially larger radii. This higher stress may cause earlier fatigue of the belt and can shorten its operating life. It is provided that the stripping feature 1 is normally retracted so it has no effect on the belt. When the printing system detects that a stress condition for mis-strips exists in the next job, then the stripping feature is activated to deflect the belt. This could be triggered if the feed source has been programmed to feed lightweight media; for example, less than 75 gsm. By actuating the stripper feature at the cycle-up of the belt module, any mid-job disturbance force is eliminated that could affect belt process velocity or lateral tracking. The stripping feature 1 is positioned in all embodiments between the transfer station 26 and the fusing station 22. It is necessarily located slightly downstream of the BUR, as shown in FIGS. 2 and 3. The small radius feature or unit 1 comprises a movable arched structure 30 rotatably mounted on the BUR support shaft and configured parallel to the curvature of the BUR. At the end portion of arched structure 30 is a radiused contact feature 2 which contacts and deforms the image carrying belt the to strip off the sheet 15.

In another embodiment of this invention, a sensor 8 can be placed to inspect the sheet lead edge as it exits the transfer nip. If a lead edge is observed to be mis-stripping, then the stripping feature can be actuated. In this case, it is likely that deflection of the belt span mid-job will cause some registration or motion quality defects, but this is preferable to forcing a hard shutdown of the system.

Figure 4:
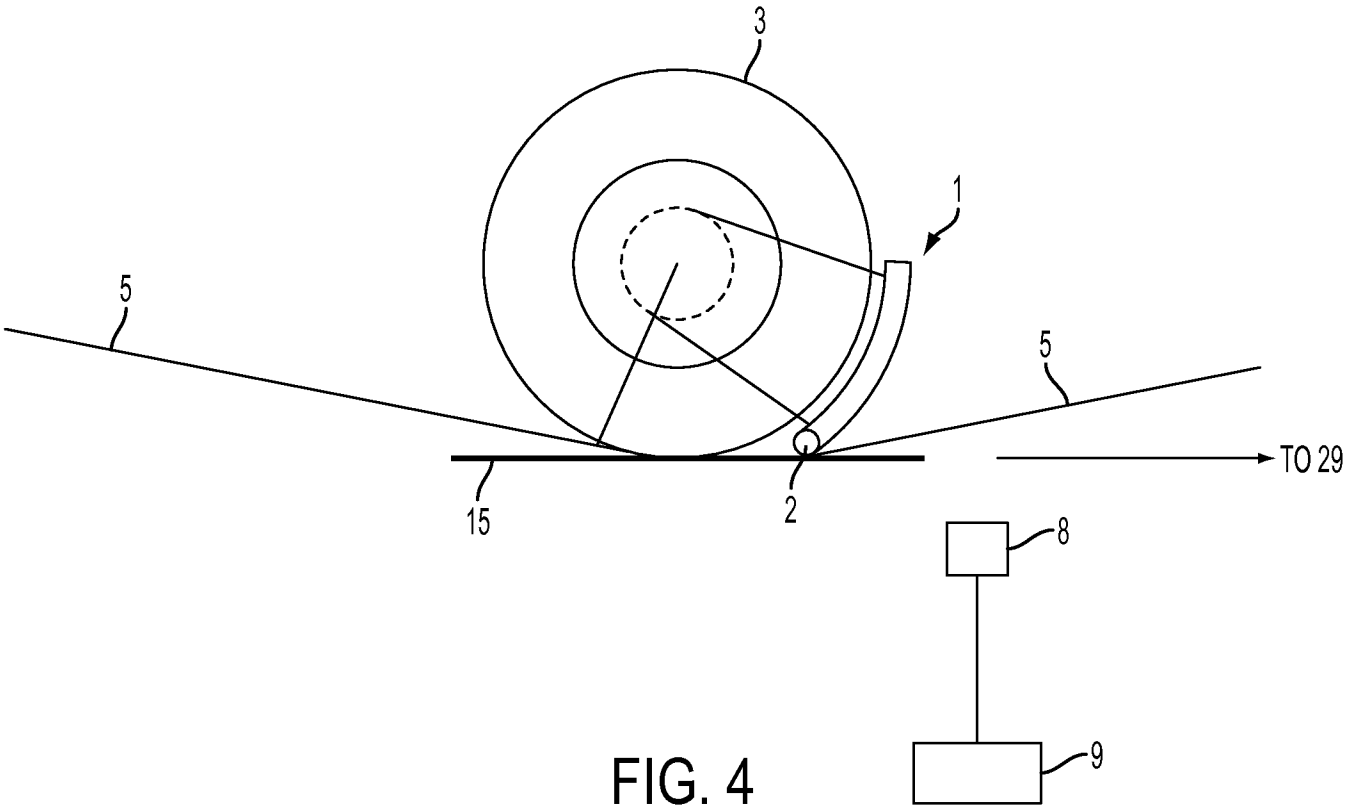
FIG. 4 is a view of the feature belt contact end as it contacts and deforms the intermediate belt to induce stripping of the paper sheet from the belt.

In FIG. 4, the radiused feature 2 is shown contacting and deforming belt 5 to dislodge paper 15 from the bottom of belt 5. The loosened paper 15 then drops toward transfer station 26 and then onto transport 29 for movement of the imaged paper 15 to the fuser station. The deforming of belt 5 to strip the paper 15 is exaggerated in FIG. 4 for clarity to show how this ITB deformation strips the media sheet.

Figure 5:
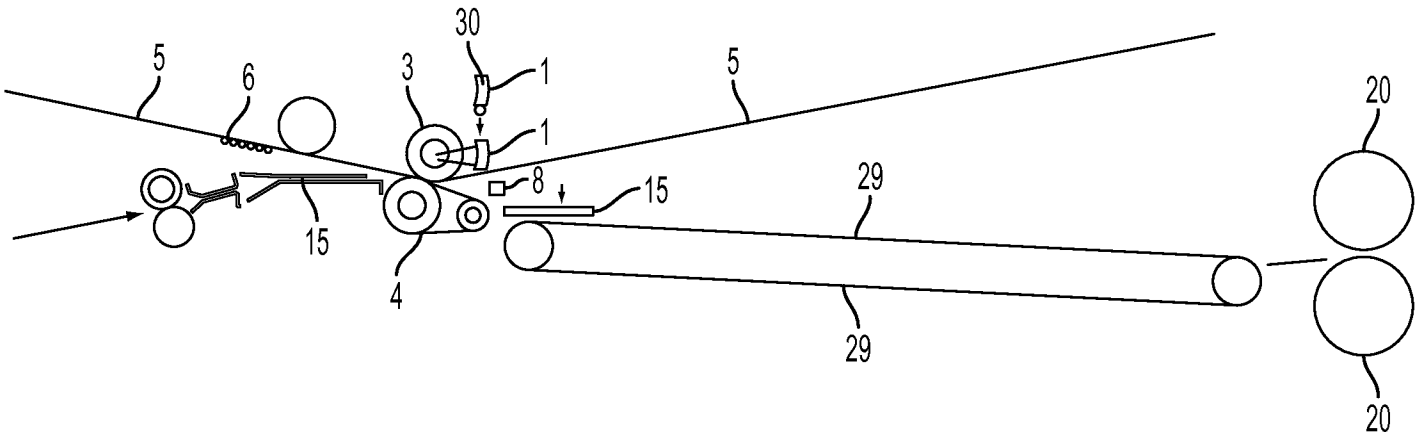
FIG. 5 is a schematic of a portion of a xerographic marking system showing the components from the transfer station to the fuser station.

In FIG. 5 the imaged paper sheet 15 travels through the nip formed by BUR 3 and BTR 4 for image transfer from ITB belt 5 to the sheet 15. The unit 1 of this invention presses against the inside surface of ITB 5 to strip the paper 15 from the ITB. Once the paper 15 is dislodged or stripped from the ITB, it falls on pre-fuser transport 29 and transported to the fuser station 20 where the image is fixed and fused onto paper sheet 15.

Figure 6:
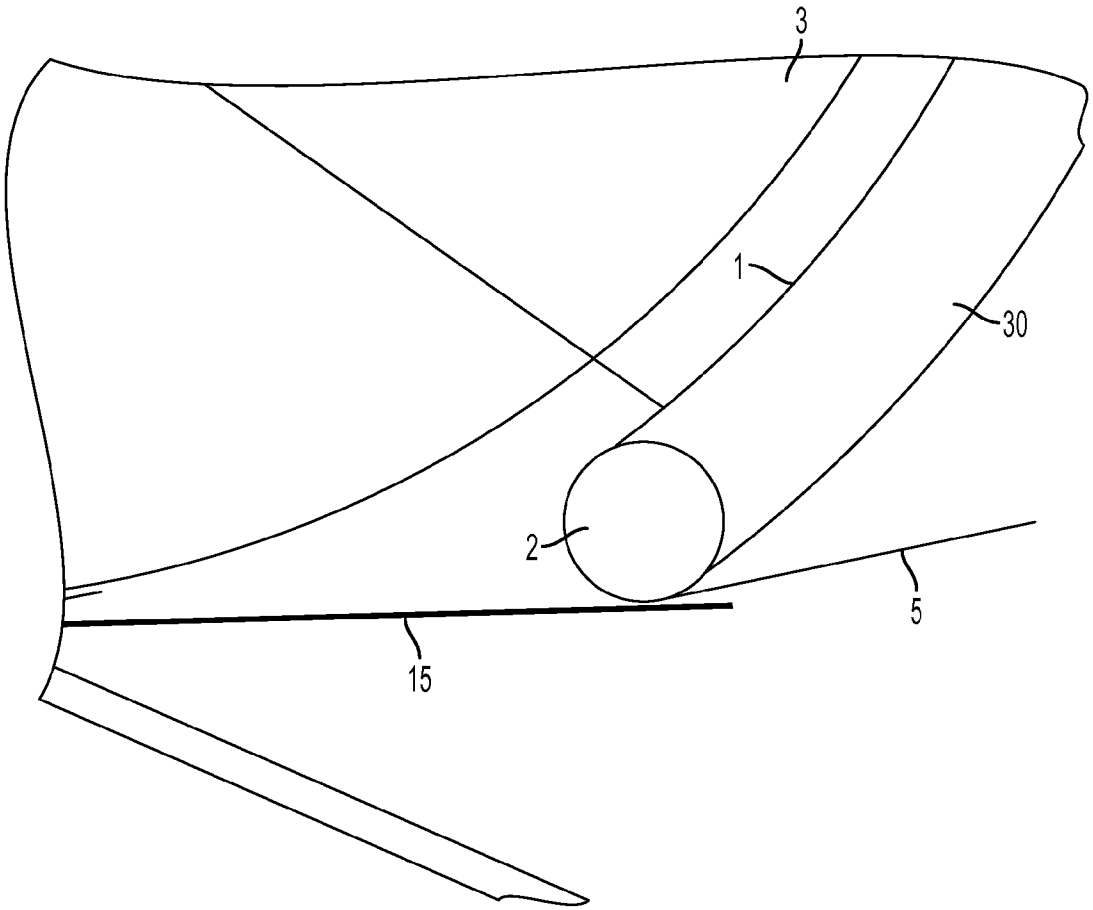
FIG. 6 illustrates an enlarged view of the sheet stripping step.

In FIG. 6 an enlarged view of the actual stripping of the sheet 15 from the intermediate belt ITB 5 by the pressing of unit 1 against the ITB to dislodge sheet 15. The contact of radiused contact feature 2 of the unit 1 against the ITB is depicted in FIG. 6.

It will be appreciated that variations of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A marking system comprising: the conventional stations of such systems, including a transfer station, a belt moving past said conventional stations; said belt holding a material image thereon, a media feed configured to move an image receiving media through said transfer station to receive said material image, a deployable feature mounted downstream of said transfer station, said feature having a belt contact portion, wherein said transfer station comprises a Back Up Roll (BUR) and a Bias Transfer Roll (BTR), said belt contact feature being configured to rotate around said BUR when actuated to press against said belt, said belt contact portion configured to apply pressure on an inside surface of said belt in order to cause deformation of said belt, said deformation configured to strip said media from said belt.

2. The marking system of claim 1 wherein said belt is a photoconductive belt.

3. The marking system of claim 1 wherein said belt is an intermediate transfer belt.

4. The marking system of claim 1 wherein said belt contact portion comprises a radius which is no more than 25% in size of a radius of any roller guiding said belt.

5. The marking system of claim 1 wherein said system is a monochromatic marking system.

6. The marking system of claim 1 wherein said system is a color marking system.

7. A transfer station of a xerographic marking system; said transfer station comprising:

an image bearing belt, a back up roll (BUR) positioned over and in contact with a bias transfer roll (BTR) to form a nip;

a movable belt contact feature located downstream of said BUR, wherein said belt contact feature is configured to rotate around said BUR when actuated to press against said belt, said belt contact feature having a radiused contact portion that is configured to press against the inside surface of said belt to dislodge or strip an imaged media sheet from said belt at a location subsequent to image transfer from said belt to said media sheet.

8. The transfer station of claim 7 wherein said radiused contact portion has a radius which is no more than 25% in size of a radius of any roller guiding said belt.

9. The transfer station of claim 7 wherein a sensor is placed in sensing contact with said location, said sensor configured to indicate if said media is adhering to said belt, said sensor in communication with a controller that is configured to move and activate said belt contact feature into contact with said belt to strip said imaged media sheet therefrom.

10. The transfer station of claim 7 wherein said belt is an intermediate transfer belt (ITB).

11. The transfer station of claim 7 wherein said imaged media subsequent to being stripped from said belt is configured to be positioned on a pre-fuser transport for movement to a fusing station.

12. The transfer station of claim 7 wherein said radiused contact portion comprises a material selected from a group consisting of metal and plastic.

13. A belt contact feature configured to be adjacent to a back up roll (BUR) in a xerographic transfer station, said belt contact feature comprising a main structure apart from said BUR, said main structure movably mounted on said BUR axis of rotation and configured to be moved in contact with an image bearing belt downstream of said transfer station, said belt contact feature having a radiused contact portion, said contact portion configured to press against said belt and strip said media therefrom after said media has an image transferred thereon.

14. The belt contact feature of claim 13 wherein said main structure is positioned downstream from said BUR and before a pre fuser transport belt.

15. The belt contact feature of claim 13 configured to be selectively deployable and located downstream from said BUR and before a pre fuser transport belt.

16. The belt contact feature of claim 13 configured to be actuated by a sensor input and associated controller.

* * * * *